US008167776B2

(12) United States Patent
Lannon et al.

(10) Patent No.: US 8,167,776 B2
(45) Date of Patent: May 1, 2012

(54) CONTROLLING EXERCISE EQUIPMENT

(76) Inventors: Michael G. Lannon, Orleans, MA (US); Mary Obana, Orleans, MA (US); Joshua Roman, Jamaica Plain, MA (US)

( * ) Notice: Subject to any disclaimer, the term of this patent is extended or adjusted under 35 U.S.C. 154(b) by 202 days.

(21) Appl. No.: 12/539,433

(22) Filed: Aug. 11, 2009

(65) Prior Publication Data

US 2010/0173749 A1 Jul. 8, 2010

Related U.S. Application Data

(60) Provisional application No. 61/088,129, filed on Aug. 12, 2008.

(51) Int. Cl.
*A63B 71/00* (2006.01)

(52) U.S. Cl. ..... 482/8; 482/1; 482/9; 482/901

(58) Field of Classification Search ..... 482/1–9, 482/900–902; 434/247
See application file for complete search history.

(56) References Cited

U.S. PATENT DOCUMENTS

2007/0265138 A1 11/2007 Ashby
2010/0056340 A1 * 3/2010 Ellis et al. ..... 482/4

OTHER PUBLICATIONS

International Search Report and Written Opinion for corresponding PCT application PCT/US2009/053518 dated Feb. 22, 2010.

* cited by examiner

*Primary Examiner* — Glenn Richman
(74) *Attorney, Agent, or Firm* — Fish & Richardson P.C.

(57) ABSTRACT

In general, a computing device disposed in a cardio exercise machine receives data related to a fitness level of a user. The computing device selects a workout program based at least in part on the data. The operations of the cardio exercise machine are controlled based at least in part on the workout program. The computing device generates audio feedback based on at least one of the user's operation of the cardio exercise machine and the selected workout program. The processed data is stored on a removable computer storage medium that is insertable into a port of the cardio exercise machine.

19 Claims, 4 Drawing Sheets

CONTROLLING EXERCISE EQUIPMENT

This application claims priority from and incorporates herein U.S. Provisional Application No. 61/088,129, filed Aug. 12, 2008, and titled "CONTROLLING EXERCISE EQUIPMENT."

BACKGROUND

This application relates generally to exercise equipment.

Regular exercise and physical activity are both important and beneficial for long-term health and well-being. Some of the benefits of exercise and physical activity include a reduced risk of premature death, heart disease, high blood pressure, cholesterol and a reduced risk of developing colon cancer and diabetes. In addition, the benefits of exercise and physical activity further include a reduced body weight, a reduced risk of depression and improve psychological well-being.

As such, various types of exercising equipment are currently known that enable an operator to exercise. Some exercising equipment may require the expertise of an instructor or a personal trainer to teach the operator the proper techniques and usage of the equipment. The user must also remember the required settings for the equipment and under-stand when these settings should be changed as the physical ability and strength of the user in-creases. Because of these limitations in order for an individual to properly and effectively use the exercise equipment the supervision of an experienced trainer is often required.

SUMMARY

In general, in one aspect, a computing device disposed in a cardio exercise machine receives data related to a fitness level of a user. The computing device selects a workout program based at least in part on the data. The operations of the cardio exercise machine are controlled based at least in part on the workout program. The computing device generates audio feedback based on at least one of the user's operation of the cardio exercise machine and the selected workout program. The processed data is stored on a removable computer storage medium that is insertable into a port of the cardio exercise machine.

The foregoing aspect may include one or more of the following features. Visual feedback is generated to guide the user through the workout program. The data includes personal data and performance data. The personal data includes one or more of the height, weight, age, and gender of the user and the performance data includes data relating to a previous performance of the user on one or more cardio exercise machines. The personal data is associated with a user's answers to questions provided by the cardio exercise machine. Selecting the workout program includes combining one or more features of respective workout programs to form the workout program. Controlling operations of the cardio exercise machine includes controlling one or more of a speed, incline, intensity, duration, and resistance provided by the cardio exercise machine. The cardio exercise machine provides the audio feedback to the user through a personal audio device configured to play audio content. The cardio exercise machine plays the audio feedback, the cardio exercise machine automatically lowers the volume of audio content being played by the personal audio device. The exercise machine includes a treadmill, stationary bicycle, stair-climber, elliptical trainer, ski-trainer, or rowing machine. At least a portion of the audio feedback is generated before the user begins the workout program. The computing device receives the data from the removable computer storage medium.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
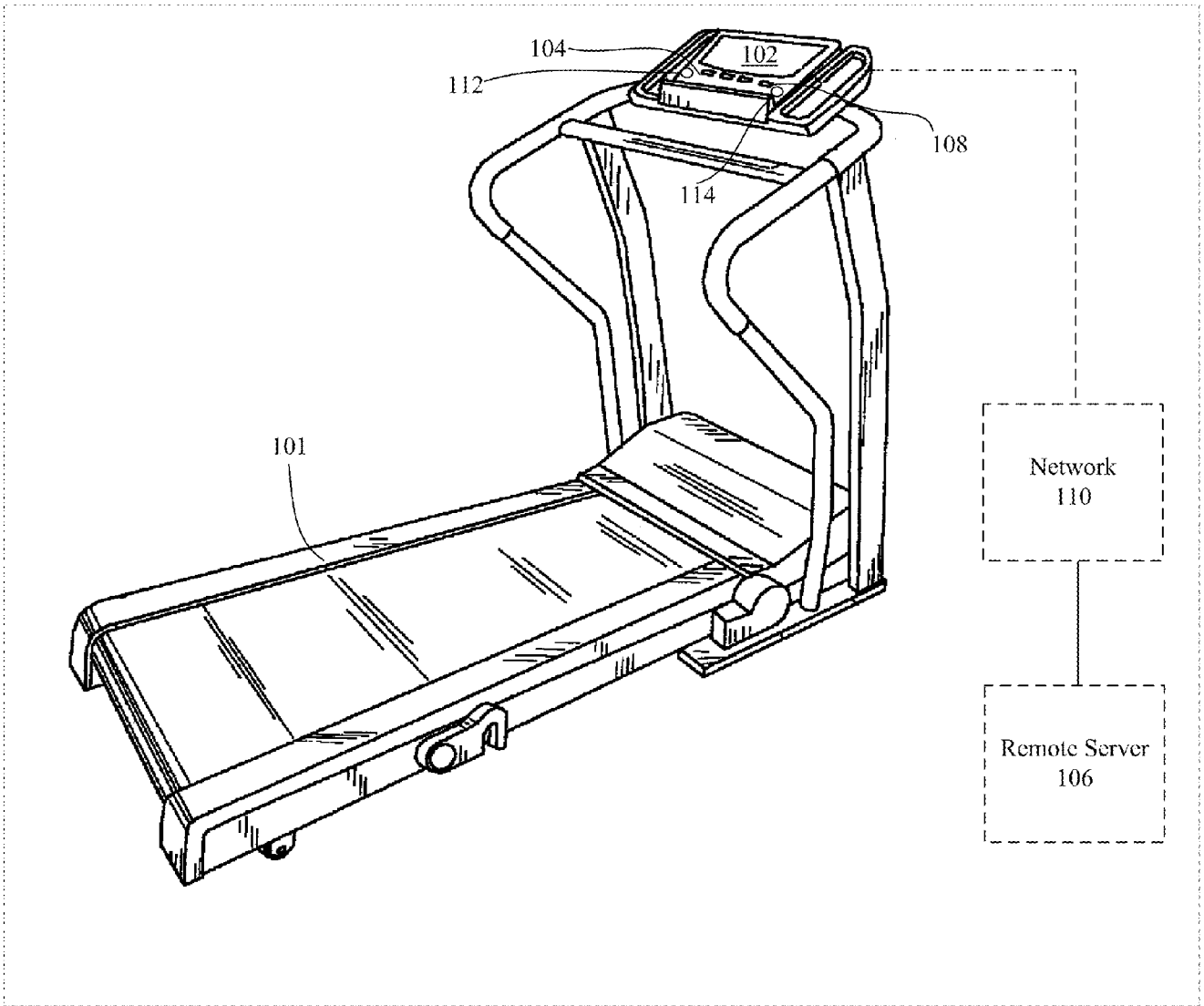
FIG. 1 is a diagram depicting an exercise apparatus.

Referring to FIG. 1, a system 100 is shown to include an exemplary cardio exercise machine 101. While the cardio exercise machine 101 depicted in FIG. 1 is a treadmill, the techniques described below could be implemented in many different types of cardio exercise machines such as stationary bicycles, recumbent stationary bicycles, stair-climbers, elliptical trainers, ski-trainers, rowing machines, step mills, versa climbers, arc trainers, or hand ergometers. A cardio-machine is typically characterized by an exercise that involves significant cardiovascular exertion in contrast to strength machines that are typically involved with weight training.

Cardio exercise machine 101 enables a user (not shown) to exercise by operating the cardio exercise machine (e.g., by running on the treadmill).

The cardio exercise machine includes an exercise system (FIG. 2) to manage operations of the cardio exercise machine. The exercise system controls the operations of the cardio exercise machine according to data associated with the user (sometimes refereed to as "user-specific data") that is stored in a memory device. Examples of a suitable memory device include a removable universal storage bus (USB) storage device, a hard drive on a computer communicating with the exercise machine over a network (e.g., the Internet), or other types of removable storage media, such as compact disks (CDs), digital video disks (DVDs), cassette disks, or floppy disks. In some examples of the memory, a remote server 106 stores the user-specific data in a remote type of storage device, and communicates with the cardio exercise machine over a network 110.

In FIG. 1, the cardio exercise machine is configured to communicate with the memory device via a port 104 into which the memory device may be inserted. In FIG. 1, the memory device is a (USB) storage device. The memory devices may also communicate wirelessly with the cardio exercise machine.

The cardio exercise machine provides a user with a plurality of multi-session cardio programs that are customized to the user's level of fitness. The workouts provided to a user are based on the user-specific data. The user-specific data includes both "personal data" and "performance data." Personal data includes a user's level of fitness that is calculated by the exercise system using a variety of factors such as age, weight, height, gender, and factors determined by a questionnaire where answers are entered into the machine via a graphical user interface rendered by the exercise system on the display 102. Alternatively, the personal data can be obtained by an on-machine testing protocol, such as a stress test that is administered by the machine automatically based on default settings at an initial use, and, which can be administered periodically, thereafter.

For example, the cardio exercise machine 101 includes display 102 that displays questions (e.g., "What is your age?"). The system presents these questions to the user and the user enters answers to these questions in the GUI. The exercise system calculates the user's level of fitness based on the answers to these questions. The user enters responses to the questions by actuating buttons 108 on the cardio exercise machine or by speaking answers to the questions into a microphone (not shown). Other techniques can be used. The user may have the option of changing the personal data if, for example, some of the information contained within the personal data has changed (e.g., if the user has lost weight, the user can update his stored weight).

The exercise system customizes workout programs based on data stored from previous workout sessions. This data includes information relating to a user's performance on past workouts, and is sometimes referred to as "performance data." These factors are combined to calculate a "fitness level" (e.g., on a numeric scale of 1-100), where the fitness level is used to modify the intensity and type of various standard workouts. For example, if a user has previously completed a workout program on a treadmill, the user might be assigned a score of "85" by the exercise system based on his performance (e.g., the user might have earned a score of "100" if he had not slowed down during a portion of the workout). A user's fitness level can be modified based on the user's performance during past workout sessions, or by re-entering other personal information.

During a session, the cardio exercise machine provides feedback in the form of exercise guidance and instruction via a combination of on-machine messaging, automatic machine control of speed, incline, intensity, and resistance via the Communications Specification for Fitness Equipment protocol (CSAFE) or other proprietary protocols, and audio-based coaching and content. If a user is exercising on a treadmill, for example, the treadmill could increase the incline and speed of its conveyer belt to augment the intensity of the user's workout. This could be in response to, for example, a scripted workout program, or in response to a user's current workout performance (e.g., by sensing a heart rate of the user).

In some examples, guidance information, such as audio coaching, is received by a user in a number of ways. First, a user may connect an existing personal audio device (e.g. an iPod®, an MP3 player, a CD player, etc.) into a line-in jack 112 on a processor board (FIG. 2), connect user-wearable headphones 208 (FIG. 2) into a line out jack 114 on the processor board. The guidance information may reside wholly or in part on the cardio platform or processor board itself. In some examples, connections between the personal audio device and the processor board can be wireless connections (e.g., a Bluetooth® connection). Once connected, the software automatically fades the user-provided audio (e.g., music) while playing the audio coaching information. The user-provided audio resumes playing, normally, during time intervals where coaching information is not being transmitted. The user can also connect headphones into a line-out jack on the processor board, and the software plays the audio coaching information. In some examples, the user can connect headphones to the personal audio device, and a different connection can link the personal audio device with the processor board. The processor board can also provide music or other content when coaching information is not being transmitted.

Once a session is completed, data pertaining to the user's performance on that session is written to the memory device, and that information is sent to a remote server system where the information is recorded (e.g., remote server 106) such that the information can be viewed via access to a web site. Future exercise sessions and programs are tailored to incorporate a user's past performance(s) and adherence to the past programs and sessions. In some examples, the audio coaching information is generated based upon a user's fitness level and performance data. For example, the audio coaching data could be constructed from a library containing a plurality of workout programs that have associated audio coaching data. A program then selects a workout program based on the personal and performance data specific to the user. In some examples, a customized workout program is constructed for a user by selecting one or more segments from different workout programs and combining them into one customized workout program. Each segment has associated audio coaching data that is combined to present the user with a guided workout program. The custom workout program is stored on one or more of the memory device 212 (FIG. 2) and the remote server 106 for later retrieval and execution by the cardio exercise machine.

Figure 2:
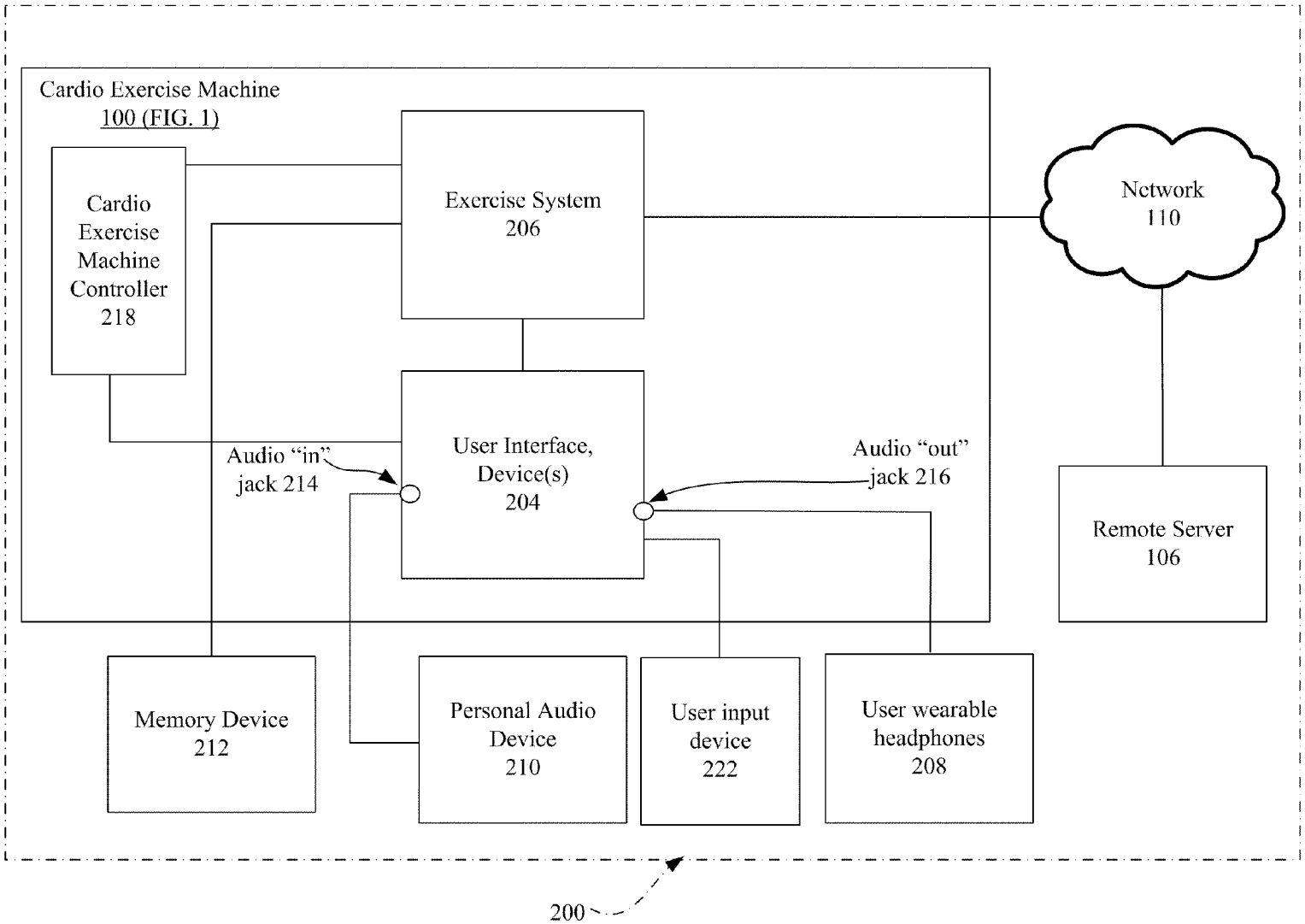
FIG. 2 is a diagram depicting an exercise apparatus that includes an exercise system.

Referring to FIG. 2, a system 200 is shown that includes a cardio exercise machine 101 such as the treadmill shown in FIG. 1. The cardio exercise machine 101 includes an exercise system 206 that controls functions relating to the operation of the cardio exercise machine, data management, and interactions with a user. The exercise system 206 can be implemented in a plurality of ways. In some examples, the exercise system 206 is implemented as a processor board and/or software. The processor board can be installed in, on, or near the cardio exercise machine 101 and may be mounted internally or externally. The software can also be configured to run on a cardio exercise machine's existing software platform that mimics the features of a customized processor board and software.

Memory device 212 communicates with the exercise system 206 in one or more of the previously-described manners to, among other things, control the operations of the cardio exercise machine 101. The mechanical operation of the cardio exercise machine 101 is controlled, for example, by a cardio exercise machine controller 218 that can receive instructions from a plurality of sources. A user controls the operations of the cardio exercise machine 101 directly via a user input device 222 (e.g., by actuating a button that manually increases the speed of a conveyer belt on a treadmill).

User input device 222 includes buttons (e.g., pressure-sensitive buttons, a touch screen, etc.), dials, a keypad, and other mechanisms that allow a user to input data into the exercise system. User interface, devices 204 includes a graphical display (e.g., an LCD screen, a series of LED lights, etc.) and/or a speaker to provide audio feedback to the user. The user interface, devices 204 communicates with the exercise system 206 to provide audio and visual feedback about the performance of the user during a workout program, and to provide operating details related to the cardio exercise machine (e.g., a display of the user interface, devices 204 displays the time remaining in the current workout program).

The exercise system 206 also provides audio feedback to the user that is coordinated with the playback of user-provided audio content provided by a personal audio device 210. The personal audio device 210 communicates with the user and the exercise system via any of the connection techniques described above. In the example of FIG. 2, the user receives audio (e.g., music, audio feedback, or guidance information) from the exercise system 206 by connecting user-wearable headphones 208 to an audio "out" jack 216. In the same example, the exercise system 206 communicates with the personal audio device 210 via audio "in" jack 214. Alternatively, the exercise system 206 can receive media over a network 110 from a remote server 106, which is provided to the user via user interface, devices 204 (e.g., a display on the user interface, devices 204 could display a video to the user), or via one or more audio connection methods.

As described above, the exercise system 206 optionally communicates with a remote server 106 to transmit and receive personal and performance data, as well as workout programs and other information. In some examples, the remote server 106 publishes the personal and performance data of a user such that the user can view workout data on a website, news feed (e.g., an RSS feed), or in an email sent to the user from the remote server 106. In this way, the user can visualize, track, organize, and manage his workout progress.

Figure 3:
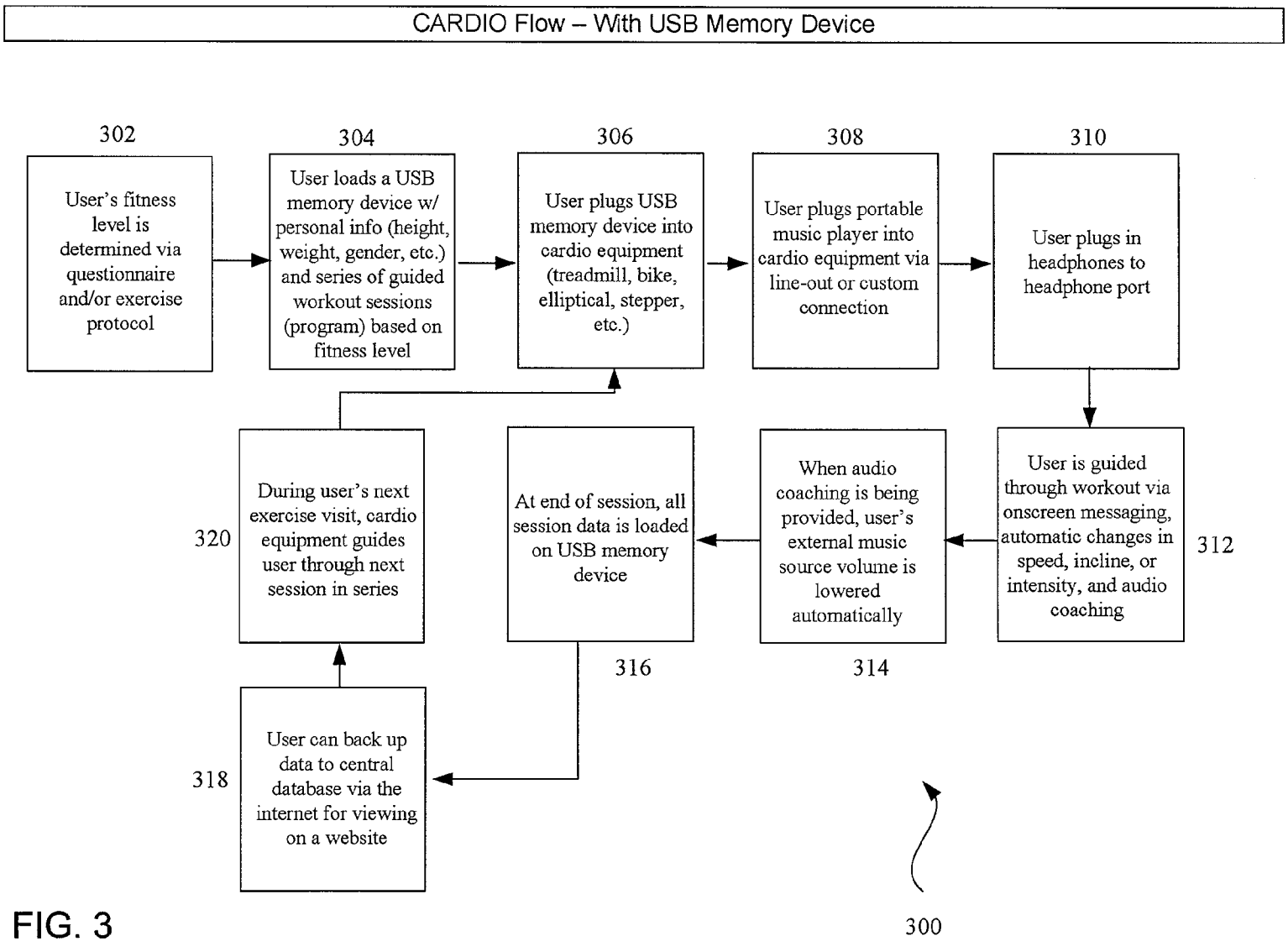
FIGS. 3 and 4 are flow charts of processing that control the exercise apparatus of FIG. 1.

Referring to FIG. 3, a process 300 to control the exercise system is shown. The process flow 300 relates to an example where a USB memory device stores user-specific data and is used in administering the workout session. If it is a user's first workout, the user's fitness level is determined 302 via the previously-described questionnaire, exercise protocol, or other method. The user loads 304 the USB memory device into the machine. The USB device includes one or more guided workout sessions that were determined by the exercise system based on the user's fitness level and are stored on the memory device. In some examples, users load new programs onto the memory device 212 via the Internet or at health club locations. The user inserts 306 the USB memory device into the cardio exercise machine, and connects 310 headphones into a provided jack. The user begins operation of the cardio exercise machine, and is guided 312 via one or more of on-screen messaging, automatic adjustments in speed, incline, or intensity, or audio coaching.

When the cardio exercise machine is attempting to provide audio coaching to the user, the cardio exercise machine lowers 314 the volume of the user-provided audio content (e.g., the music playing on the user's mp3 player). Similarly, the cardio exercise machine restores the volume of the user-provided audio content after the audio coaching has been provided. Once the user In another example, an imbedded device manages cardio exercise equipment with user-specific exercise programming and activity tracking. That is, the removable storage functionality is not necessary in some implementations.

Figure 4:
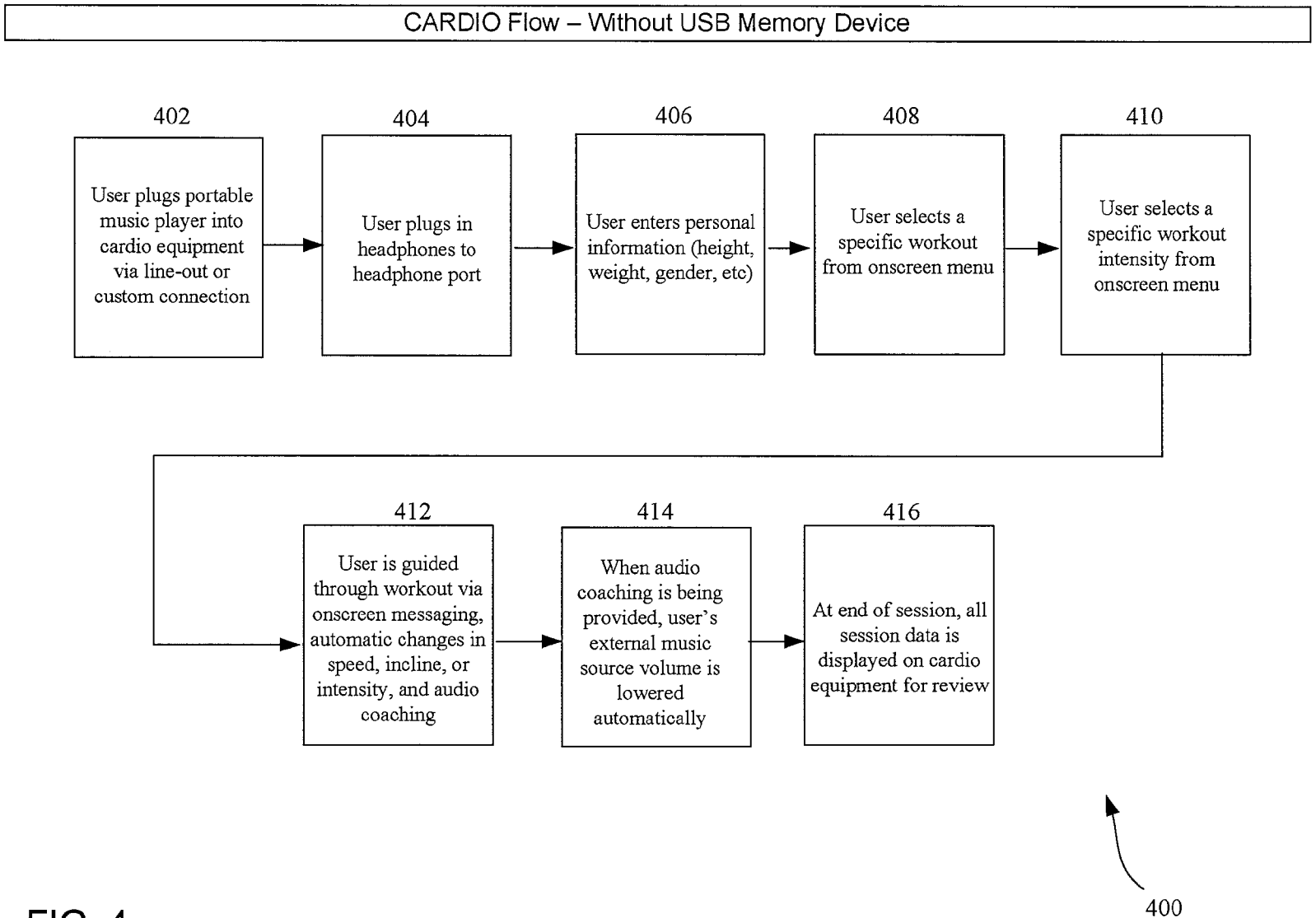

Referring to FIG. 4, a process 400 to control the exercise system is shown. The user connects 402 a personal audio device to the exercise system and also connects 404 headphones to a headphone jack (e.g., a port on the cardio exercise or machine, a port on the personal audio device, depending on the configuration). The user enters 406 personal information into the exercise system using the user interface, devices 204 (FIG. 2).

In some examples, an exercise system includes a set of "pre-loaded" exercise sessions that are selectable by the user. Cardio programs are personalized to each user's level of fitness using a number of factors, including an on-machine testing protocol, and other factors described above. The user selects 408 a workout from an onscreen menu, or from a list of workouts provided audibly to the user from the exercise system. The user can also select 410 custom options relating to the workout (e.g., the intensity of the workout, the type of workout, etc.). The exercise system provides 412 exercise guidance and instruction via a combination of on-machine messaging, automatic machine control of speed, incline, intensity, etc. via the CSAFE protocol or other proprietary protocols, and audio-based coaching and content.

Again, for the audio coaching, two levels of interaction exist. First, a user can connect an existing personal audio device (e.g. iPod, MP3 player, CD player, etc.) into a line-in jack on the processor board, connect headphones into a line out jack on the new processor board, and then the software will automatically fade 414 the user-provided audio (e.g., music) while playing the audio coaching information. The user's music will then resume playing during time intervals where coaching information is not being transmitted. A user can also connect headphones into a line-out jack on the processor board, and then the software will play the audio coaching information. The processor board can also provide music or other content when coaching information is not being transmitted.

At the end of the session the user's performance data is displayed 416 on the screen. Audio content and messaging may be fixed for the life of the machine, or could be updated via a management function or future networking of the equipment.

These systems may or may not be networked (wired or wirelessly) to the internet for two-way communication, session updates, program updates, device software updates, remote diagnostics, and other functions.

The various components of the system described herein may be implemented as a computer program using a general-purpose computer system. Such a computer system typically includes a main unit connected to both an output device that displays information to a user and an input device that receives input from a user. The main unit generally includes a processor connected to a memory system via an interconnection mechanism. The input device and output device also are connected to the processor and memory system via the interconnection mechanism.

One or more output devices may be connected to the computer system. Example output devices include, but are not limited to, a cathode ray tube (CRT) display, liquid crystal displays (LCD) and other video output devices, printers, communication devices such as a modem, and storage devices such as disk or tape. One or more input devices may be connected to the computer system. Example input devices include, but are not limited to, a keyboard, keypad, track ball, mouse, pen and tablet, communication device, and data input devices. The invention is not limited to the particular input or output devices used in combination with the computer system or to those described herein.

The computer system may be a general purpose computer system which is programmable using a computer programming language, a scripting language or even assembly language. The computer system may also be specially programmed, special purpose hardware. In a general-purpose computer system, the processor is typically a commercially available processor. The general-purpose computer also typically has an operating system, which controls the execution of other computer programs and provides scheduling, debugging, input/output control, accounting, compilation, storage assignment, data management and memory management, and communication control and related services.

A memory system typically includes a computer readable medium. The medium may be volatile or nonvolatile, writeable or nonwriteable, and/or rewriteable or not rewriteable. A memory system stores data typically in binary form. Such data may define an application program to be executed by the microprocessor, or information stored on the disk to be processed by the application program. The invention is not limited to a particular memory system.

A system such as described herein may be implemented in software or hardware or firmware, or a combination of the three. The various elements of the system, either individually or in combination may be implemented as one or more computer program products in which computer program instructions are stored on a computer readable medium for execution by a computer. Various steps of a process may be performed by a computer executing such computer program instructions. The computer system may be a multiprocessor computer system or may include multiple computers connected over a computer network. The components shown in the various figures may be separate modules of a computer program, or may be separate computer programs, or may include separate modules or programs, which may be operable on separate computers. The data produced by these components may be stored in a memory system or transmitted between computer systems.

Having now described exemplary embodiments, it should be apparent to those skilled in the art that the foregoing is merely illustrative and not limiting, having been presented by way of example only. Numerous modifications and other embodiments are within the scope of one of ordinary skill in the art and are contemplated as falling within the scope of the invention.

What is claimed is:

1. A method comprising:

receiving, by a computing device disposed in a cardio exercise machine, data related to a fitness level of a user;

selecting, by the computing device based at least in part on the data, a first segment from a first workout program and a second segment from a second workout program;

generating a customized workout program by combining the first segment and the second segment;

controlling operations of the cardio exercise machine based at least in part on the customized workout program;

generating, by the computing device, audio feedback based on at least one of the user's operation of the cardio exercise machine and the customized workout program;

generating performance data based at least in part on the user's operation of the cardio exercise machine; and storing the performance data on a removable computer storage medium that is insertable into a port of the cardio exercise machine.

2. The method of claim 1, further comprising generating visual feedback to guide the user through the customized workout program.

3. The method of claim 1, wherein the data is comprised of personal data and performance data.

4. The method of claim 3, wherein the personal data comprises one or more of the height, weight, age, and gender of the user and the performance data comprises data relating to a previous performance of the user on one or more cardio exercise machines.

5. The method of claim 4, wherein the personal data is associated with a user's answers to questions provided by the cardio exercise machine.

6. The method of claim 1, wherein controlling operations of the cardio exercise machine comprises controlling one or more of a speed, incline, intensity, duration, and resistance provided by the cardio exercise machine.

7. The method of claim 1, wherein the cardio exercise machine provides the audio feedback to the user through a personal audio device configured to play audio content.

8. The method of claim 7, wherein, when the cardio exercise machine plays the audio feedback, the cardio exercise machine automatically lowers the volume of audio content being played by the personal audio device.

9. The method of claim 1, wherein the exercise machine comprises a treadmill, stationary bicycle, stair-climber, elliptical trainer, ski-trainer, or rowing machine.

10. The method of claim 1, wherein at least a portion of the audio feedback is generated before the user begins the customized workout program.

11. The method of claim 1, wherein the computing device receives the data from the removable computer storage medium.

12. A system comprising a cardio exercise machine;

a control unit, comprising a port configured to receive a removable computer storage medium; and a computing device configured to:

receive data related to a fitness level of a user;

select, based at least in part on the data, a first segment from a first workout program and a second segment from a second workout program;

generate a customized workout program by combining the first segment and the second segment;

control operations of the cardio exercise machine based at least in part on the customized workout program;

generate audio feedback based on at least one of the user's operation of the cardio exercise machine and the customized workout program;

generate performance data based at least in part on the user's operation of the cardio exercise machine; and store the performance data on the removable computer storage medium that is insertable into the port.

13. The system of claim 12, wherein the computing device is configured to generate visual feedback to guide the user through the customized workout program.

14. The system of claim 12, wherein the personal data comprises one or more of the height, weight, age, and gender of the user and the performance data comprises data relating to a previous performance of the user on one or more cardio exercise machines.

15. The system of claim 14, wherein the personal data is associated with a user's answers to questions provided by the cardio exercise machine.

16. A computer program product tangibly embodied in a computer-readable medium, the computer program product comprising instructions that, when executed on a computing device, cause a cardio exercise machine to:

receive data related to a fitness level of a user;

select, based at least in part on the data, a first segment from a first workout program and a second segment from a second workout program;

generate a customized workout program by combining the first segment and the second segment;

control operations of the cardio exercise machine based at least in part on the customized workout program;

generate audio feedback based on at least one of the user's operation of the cardio exercise machine and the customized workout program;

generate performance data based at least in part on the user's operation of the cardio exercise machine; and store the performance data on the removable computer storage medium that is insertable into the port.

17. The computer program product of claim 16, further comprising instructions to generate visual feedback to guide the user through the customized workout program.

18. The computer program product of claim 16, wherein the personal data comprises one or more of the height, weight, age, and gender of the user and the performance data comprises data relating to a previous performance of the user on one or more cardio exercise machines.

19. The computer program product of claim 18, wherein the personal data is associated with a user's answers to questions provided by the cardio exercise machine.

* * * * *